US009192530B2

(12) United States Patent
Stent et al.

(10) Patent No.: US 9,192,530 B2
(45) Date of Patent: Nov. 24, 2015

(54) MOVEABLE SEAT

(71) Applicants: Mark Stent, Basingstoke (GB); Matthew Wiacek, Yateley (GB); Alex Manning, Basingstoke (GB)

(72) Inventors: Mark Stent, Basingstoke (GB); Matthew Wiacek, Yateley (GB); Alex Manning, Basingstoke (GB)

(73) Assignee: NACCO Materials Handling Group, Inc., Fairview, OR (US)

( * ) Notice: Subject to any disclaimer, the term of this patent is extended or adjusted under 35 U.S.C. 154(b) by 1 day.

(21) Appl. No.: 14/340,213

(22) Filed: Jul. 24, 2014

(65) Prior Publication Data

US 2015/0028641 A1 Jan. 29, 2015

Related U.S. Application Data

(60) Provisional application No. 61/859,387, filed on Jul. 29, 2013.

(51) Int. Cl.

| | |
|---|---|
| ***A47C 9/06*** | (2006.01) |
| ***A61G 5/14*** | (2006.01) |
| ***A47C 1/022*** | (2006.01) |
| ***A47C 7/56*** | (2006.01) |

(52) U.S. Cl.

CPC . *A61G 5/14* (2013.01); *A47C 1/022* (2013.01); *A47C 7/56* (2013.01); *A47C 9/06* (2013.01)

(58) Field of Classification Search

CPC ..... A47C 3/18; A47C 9/022; A47C 9/025; A47C 9/06; A47C 1/022; A47C 7/56; A61G 5/14

See application file for complete search history.

(56) References Cited

U.S. PATENT DOCUMENTS

| | | | | |
|---|---|---|---|---|
| 607,275 A | | 7/1898 | Rainbow | |
| 988,515 A | | 4/1911 | Shutt | |
| 1,428,018 A | | 9/1922 | Erickson | |
| 1,509,863 A | | 9/1924 | Erickson | |
| 2,636,549 A | * | 4/1953 | Geller | A47B 5/06 108/48 |
| 2,815,064 A | * | 12/1957 | Witzel | A47C 9/06 248/371 |
| 3,093,414 A | * | 6/1963 | Eames | A47C 1/126 297/14 |
| 3,594,037 A | * | 7/1971 | Sherman | A47C 1/036 297/14 |
| 4,632,457 A | | 12/1986 | Hofrichter et al. | |
| 4,884,842 A | | 12/1989 | Finkelstein | |
| 5,044,472 A | | 9/1991 | Dammeyer et al. | |
| 5,275,255 A | | 1/1994 | Huntley et al. | |
| 5,328,231 A | | 7/1994 | Raymond | |
| 5,328,239 A | | 7/1994 | Yamazaki | |
| 5,364,151 A | * | 11/1994 | Yurasits | A47C 9/06 180/326 |
| 5,788,015 A | | 8/1998 | Seng et al. | |
| 5,791,729 A | * | 8/1998 | McCormick | A47C 9/06 297/14 |
| 5,839,542 A | | 11/1998 | Seng et al. | |
| 6,042,178 A | * | 3/2000 | Hetherington | A47C 9/06 297/14 |

(Continued)

FOREIGN PATENT DOCUMENTS

| | | |
|---|---|---|
| DE | 4232693 A1 | 4/1993 |
| DE | 102006029759 A1 | 1/2008 |

(Continued)

OTHER PUBLICATIONS

Jungheinrich, ESE 20 Operating Instructions 50052902 07.99, Jungheinrich Aktiengesellschaft, Hamburg, Germany.

(Continued)

*Primary Examiner* — Philip Gabler

(57) ABSTRACT

A seat configured to provide support for a user at various positions, such as standing position or a seated position, is provided.

14 Claims, 13 Drawing Sheets

(56) References Cited

U.S. PATENT DOCUMENTS

| | | | |
|---|---|---|---|
| 6,189,964 | B1 | 2/2001 | Henshaw et al. |
| 6,702,372 | B2 | 3/2004 | Tholkes et al. |
| 7,347,299 | B2 | 3/2008 | Billger et al. |

FOREIGN PATENT DOCUMENTS

| | | | |
|---|---|---|---|
| EP | 1116626 | A2 | 7/2001 |
| EP | 2518004 | A1 | 10/2012 |
| FR | 731784 | A | 9/1932 |
| FR | 2288497 | | 5/1976 |
| GB | 2289669 | A | 11/1995 |

OTHER PUBLICATIONS

Extended European Search Report for EP 1478736.6 dated Jan. 8, 2015.

* cited by examiner

MOVEABLE SEAT

TECHNICAL FIELD

The present disclosure relates to moveable seats, and in particular to seats configured to move between a user seated position and a user standing position.

SUMMARY

The present inventors have recognized that there are situations where an equipment operator, office worker, or other suitable seat user, desires to spend some time standing and some time seated. The present inventors have also recognized that when a user is standing, a seat may be positioned to provide support for the user in a manner that is different from the support provided by the seat when the user is sitting. A seat configured to provide support for a user at various positions, optionally including a standing position and a seated position, is therefore provided.

DETAILED DESCRIPTION

Figure 2:
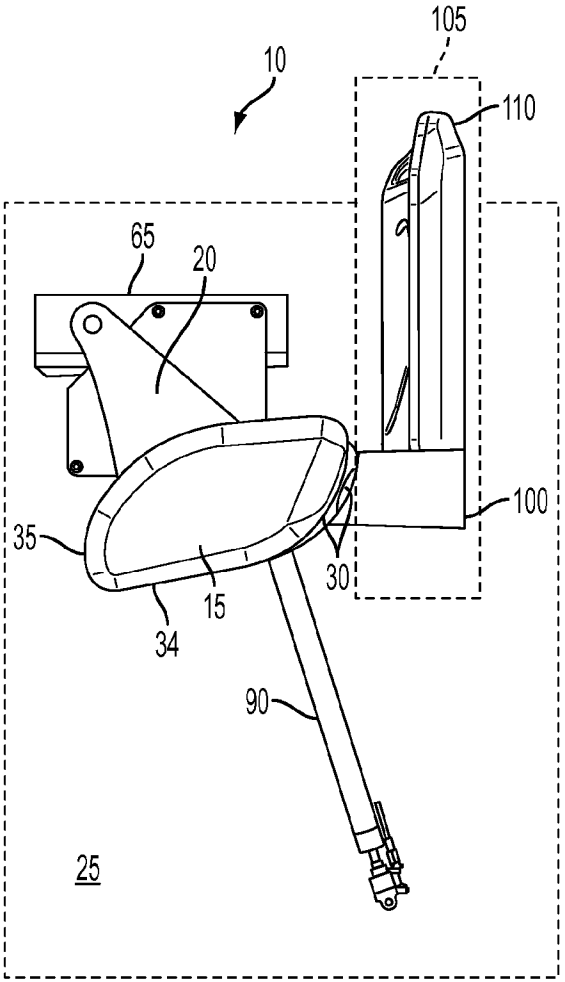
FIG. 2 illustrates a left side partially cut-away view of the moveable seat of FIG. 1 at a seated position.

An embodiment of a moveable seat 10 is described with reference to FIGS. 1-8. A seat base 15 is supported by a connection device, such as a cantilever arm 20, which is in turn supported by a support structure, such as first wall 25. The seat base 15 includes a back end 30, a front end 35, a first side 40 and a second side 45 where each of the sides 40 and 45 extend between the back end 30 and the front end 35. A top surface 32 preferably supports a user at both a seated and at a standing position as described below, but the bottom surface 34 may support a user at a standing position in some embodiments. In the illustrated embodiment, the cantilever arm 20 is rigidly connected to the first side 40 of the seat base 15. An intended sitting position for the seat base 15 is to have a user's legs extend over the front end 35 when seated.

Figure 1:
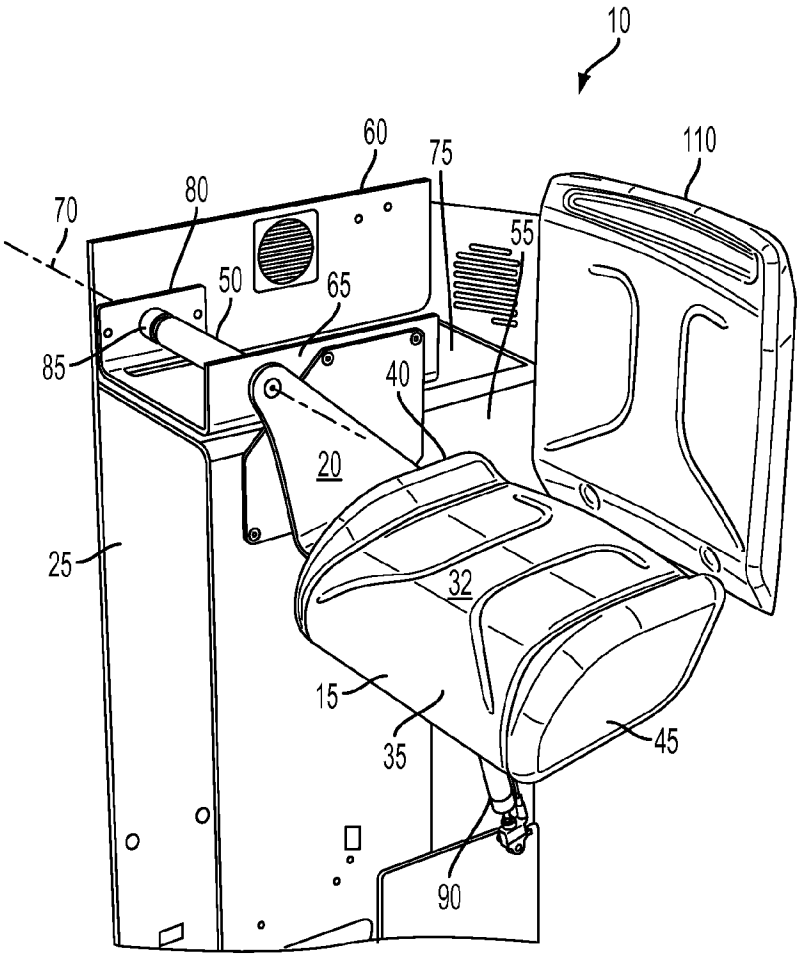
FIG. 1 illustrates a left front partially cut-away isometric view of an exemplary moveable seat at a seated position.
Figure 1A:
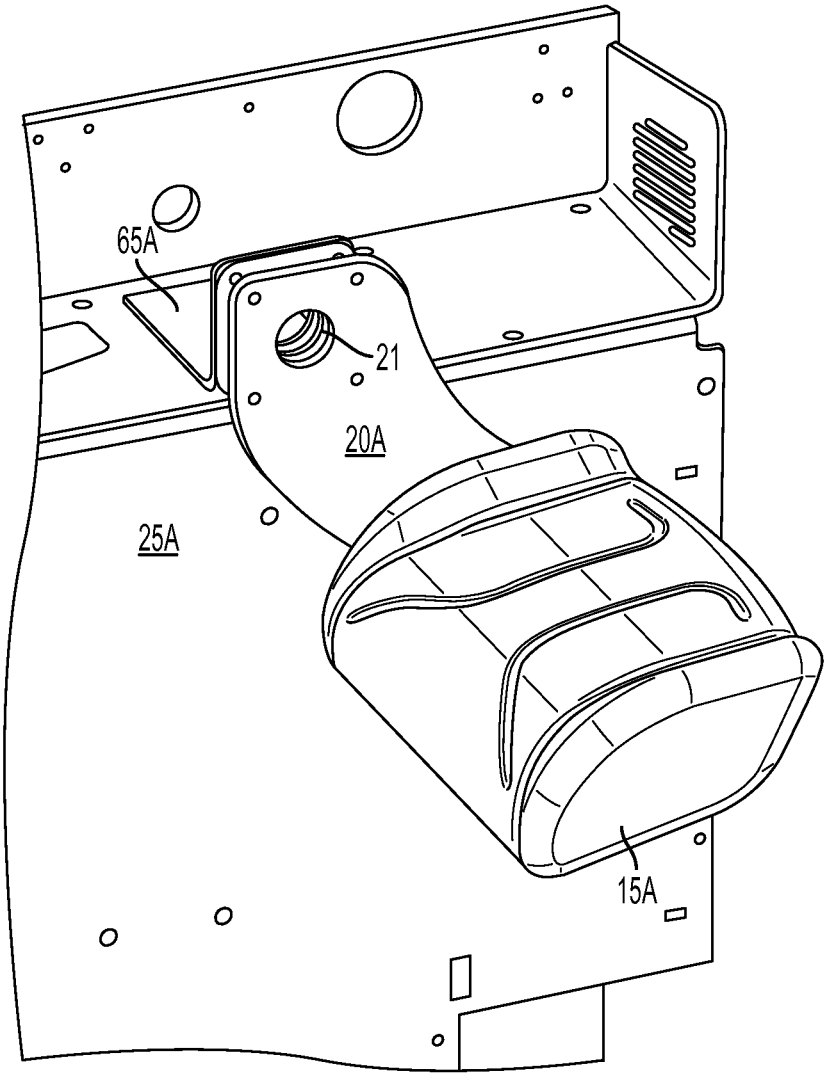
FIG. 1A illustrates a left front partially cut-away isometric view of another exemplary moveable seat at a seated position.
Figure 15B:
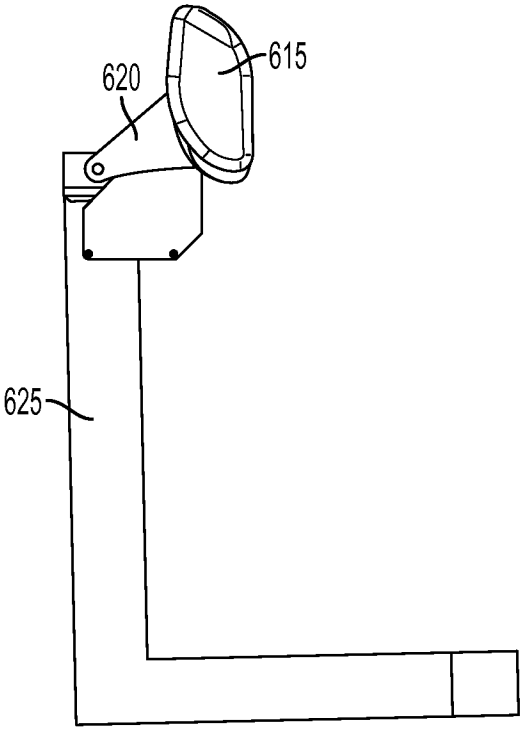
FIG. 15B illustrates a left side view of the moveable seat of FIG. 15A at a standing position.
Figure 15A:
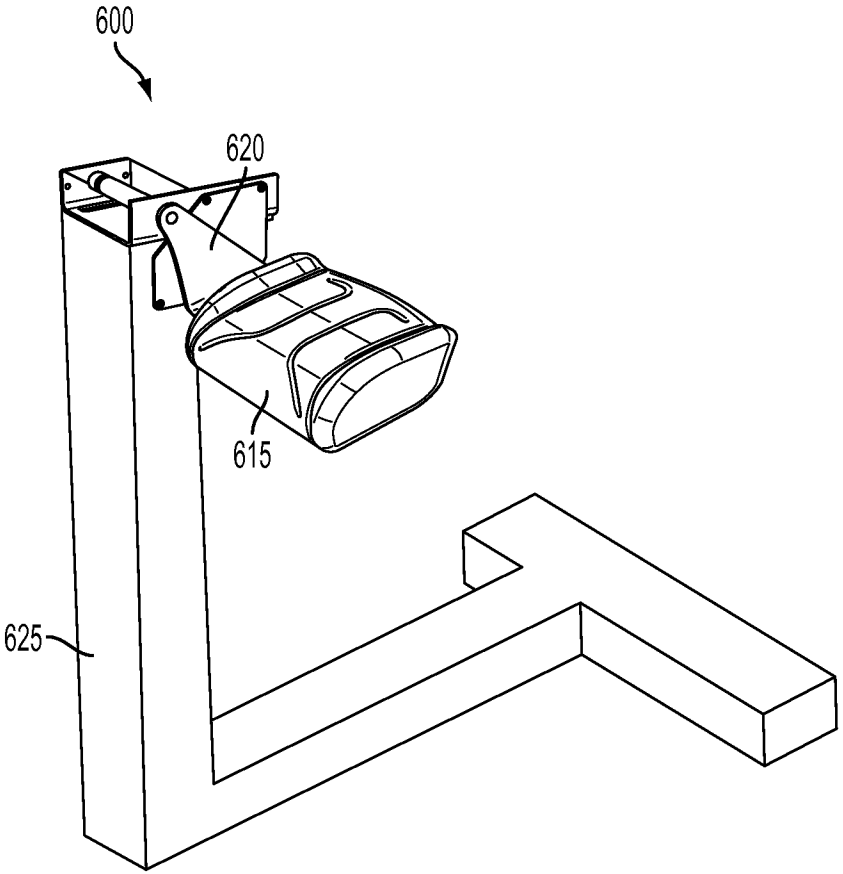
FIG. 15A illustrates a left front isometric view of an exemplary moveable seat at a seated position.

Cantilever arm 20 is affixed to a first end of a pivot shaft 50 that extends through an inside wall portion 55 of the wall 25 and through the wall 25 to an outside wall portion 60. Wall 25 may include air between the inside and outside wall portions 55 and 60, or optionally may include a solid material between the inside and outside wall portions 55 and 60. Optionally, the pivot shaft 50 may simply extend through an aperture in the inside wall portion 55, but preferably a pivot bearing, such as bracket 65, reinforces the inside wall portion 55 and bears at least some of the weight of the seat base 15 and any load placed upon it. The pivot bearing supports the pivot shaft 50 such that pivot shaft 50 may rotate about its longitudinal axis 70. Preferably, the longitudinal axis of the pivot about which the seat base moves, regardless of whether the pivot is an actual mechanical pivot or a functional pivot, does not intersect the seat base and thus creates a travel path, as discussed below. For example, the longitudinal axis 70 is above the seat base 15 when the seat base 15 is located at a seated position, that is, the seat base 15 is between the longitudinal axis 70 and a floor as illustrated in FIGS. 1 and 15A. The bracket 65 may optionally include a low-friction insert made of a polymer or other suitable material, a ball bearing race, or other suitable device for facilitating rotation of the pivot shaft 50. The pivot bearing also hinders the pivot shaft 50 from moving towards a floor, such as the floor of a rider pallet truck, by creating a physical obstacle against such movement. Optionally, the pivot bearing may be affixed to one or more support structures internal to the wall 25. For example, bracket 65 is secured to beam 75 within wall 25. In other embodiments, optionally, the cantilever arm 20 may be moveably affixed only to the inside wall portion 55 on an exterior surface, an interior surface, or both. For example, see FIG. 1A that illustrates seat base 15A connected to cantilever arm 20A which is rotatably connected to bracket 65A by a rotating device, such as a turntable bearing 21.

The second end of the pivot shaft 50 is rotatably supported by the outer wall portion 60. For example, the second end of the pivot shaft 50 optionally protrudes into or through an aperture in the outer wall portion 60. Optionally, as illustrated, a pivot plate 80 may be affixed to the outer wall portion 60 and may include an aperture (not illustrated) surrounded by a boss or flange 85, or just the boss or flange 85 without the aperture in some embodiments, to facilitate retaining the second end of the pivot shaft 50 such that the pivot shaft 50 rotates about its longitudinal axis 70 while hindering the pivot shaft 50 from moving towards a floor, such as the floor of a rider pallet truck, by creating a physical obstacle against such movement. One or more of the aperture or a surrounding boss or flange 85 optionally includes a device to facilitate rotation of the pivot shaft 50, such as a low-friction insert made of a polymer or other suitable material, a ball bearing race, or other suitable device.

Figure 3:
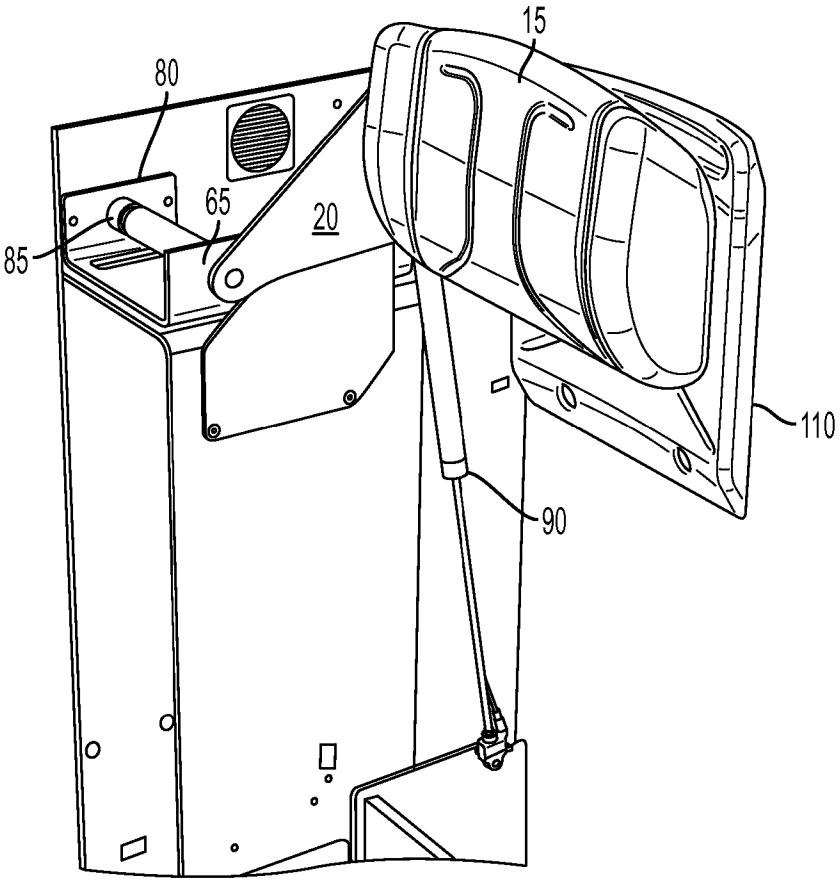
FIG. 3 illustrates a left side partially cut-away isometric view of the moveable seat of FIG. 1 at a standing position.
Figure 6:
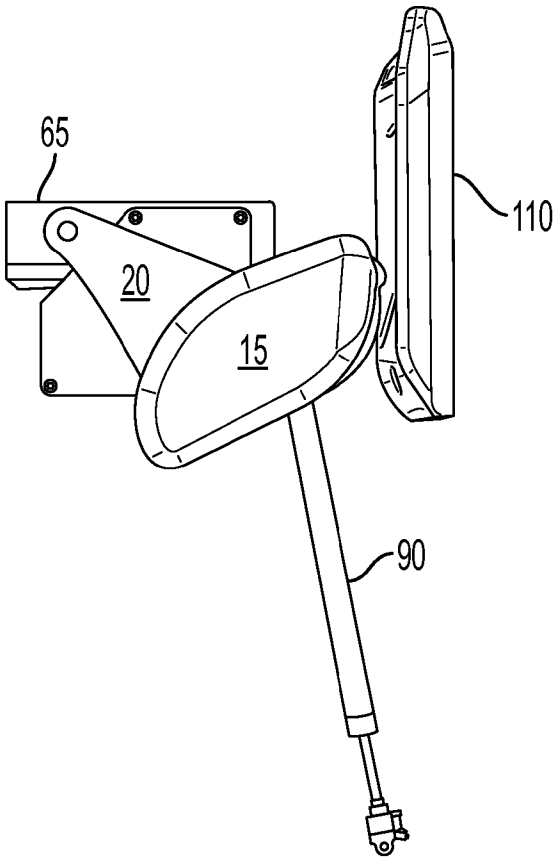
FIG. 6 illustrates a left side partial assembly view of the moveable seat of FIG. 5.
Figure 5:
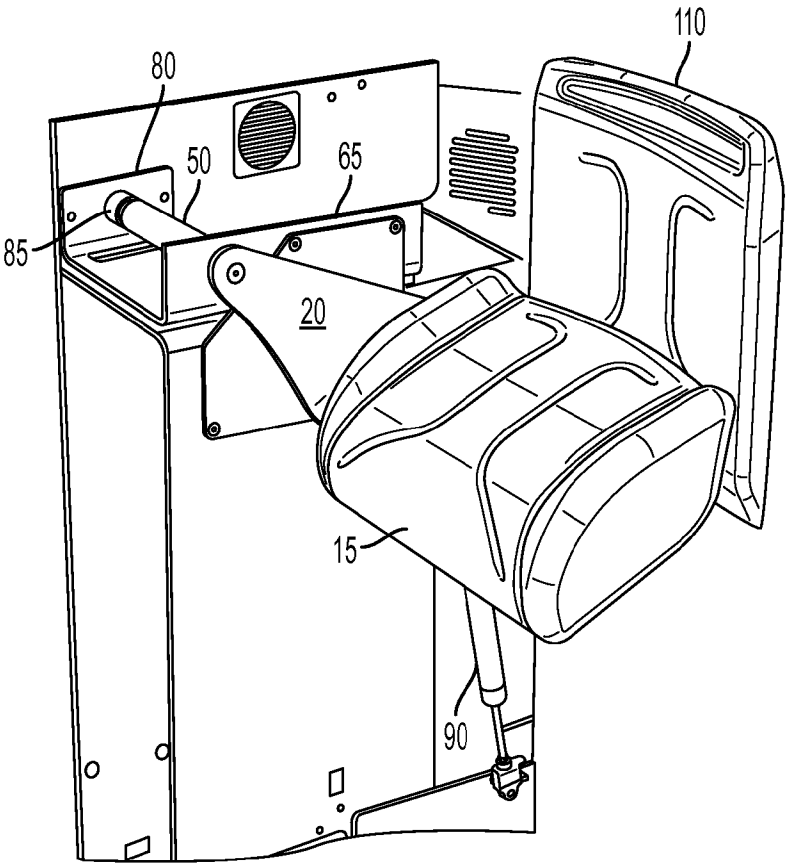
FIG. 5 illustrates a left side partially cut-away isometric view of the moveable seat of FIG. 1 at an intermediate seated position that is between the seated position of FIG. 1 and the standing position of FIG. 3.
Figure 8:
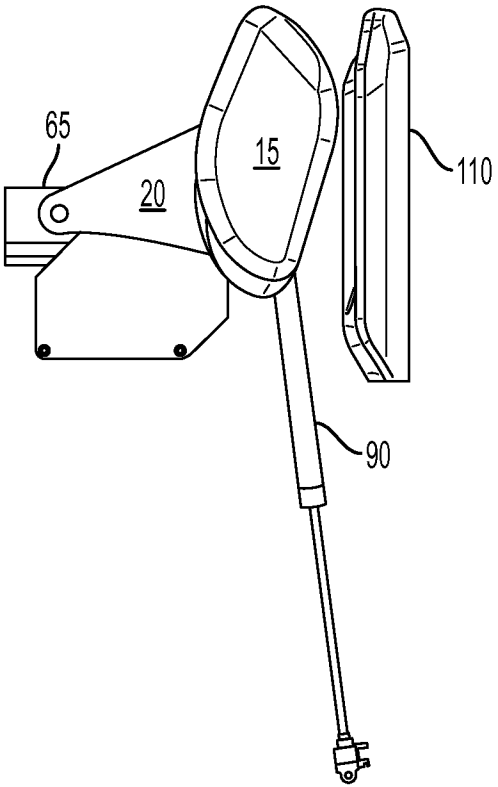
FIG. 8 illustrates a left side partial assembly view of the moveable seat of FIG. 7.
Figure 7:
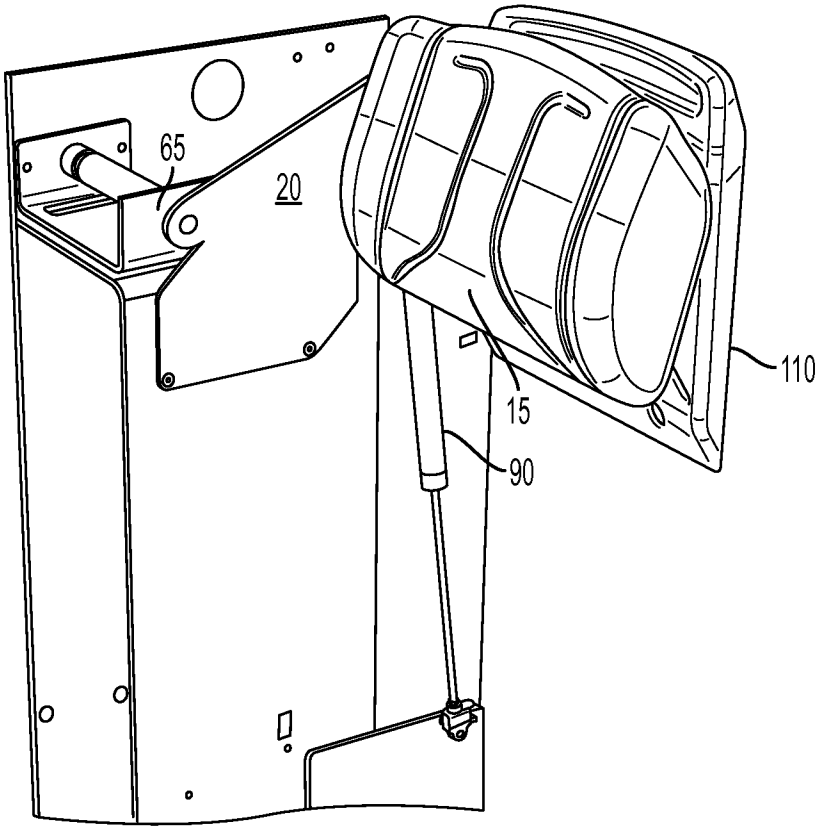
FIG. 7 illustrates a left side partially cut-away isometric view of the moveable seat of FIG. 1 at an intermediate standing position that is between the intermediate seated position of FIG. 5 and the standing position of FIG. 3.

The seat base 15 is mounted to the support structure such that the seat base 15 is moveable between at least two positions, preferably along a travel path as discussed below. For example, the seat base may be moved to a seated position as illustrated in FIG. 2, to a standing position as illustrated in FIG. 3, and optionally, to positions intermediate the seated and standing positions, for example, as illustrated in FIGS. 5-8.

Optionally, a moveable seat, such as moveable seat 10, may include a support structure that includes support structure components on both sides of a seat base, such as seat base 15. In such embodiments, the seat base may be supported by two arms, similar to cantilever arm 20, that are configured for movement with respect to the support structure to facilitate moving the seat base between a seated position and a standing position.

Figure 2A:
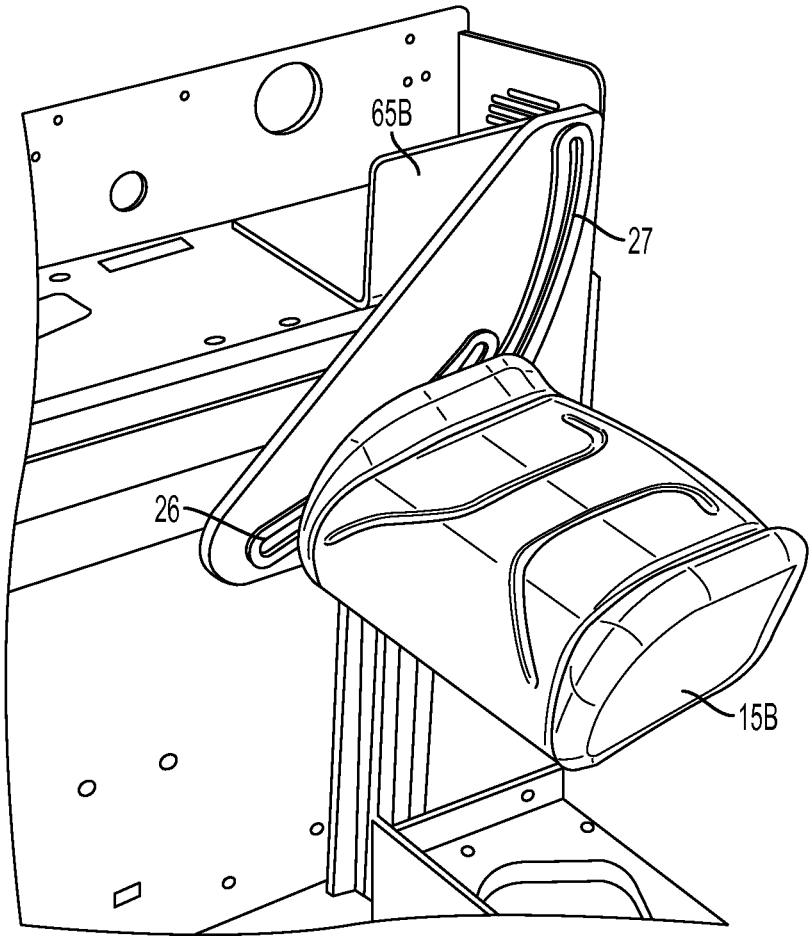
FIG. 2A illustrates a left front isometric view of another exemplary moveable seat at a seated position.

In other embodiments, a seat base, such as seat base 15B (FIG. 2A), may optionally be configured with a connection device comprising one or more attachment points, such as pegs (not illustrated), that engage shaped slots 26 and 27 formed in the support structure. Shaped slots 26 and 27 create a functional pivot, that is, there is no actual pivot mechanism about which the seat base 15 moves, but there is a pivot point associated with the curvature of the shaped slots 26 and 27 that creates the functional pivot about which the seat base 15B moves. The longitudinal axis of the functional pivot about which the seat base 15B moves does not intersect the seat base 15B and thus creates a travel path, as discussed below. Other suitable structures and mechanisms may be used to moveably affix a seat base to a support structure. The shape of the shaped slots 26 and 27 dictates the path over which the seat base 15B travels when moving between a seated position and a standing position, and may be altered to accommodate various design considerations. For example, a slot could be linear instead of curved, or a single slot may be used.

Figure 2B:
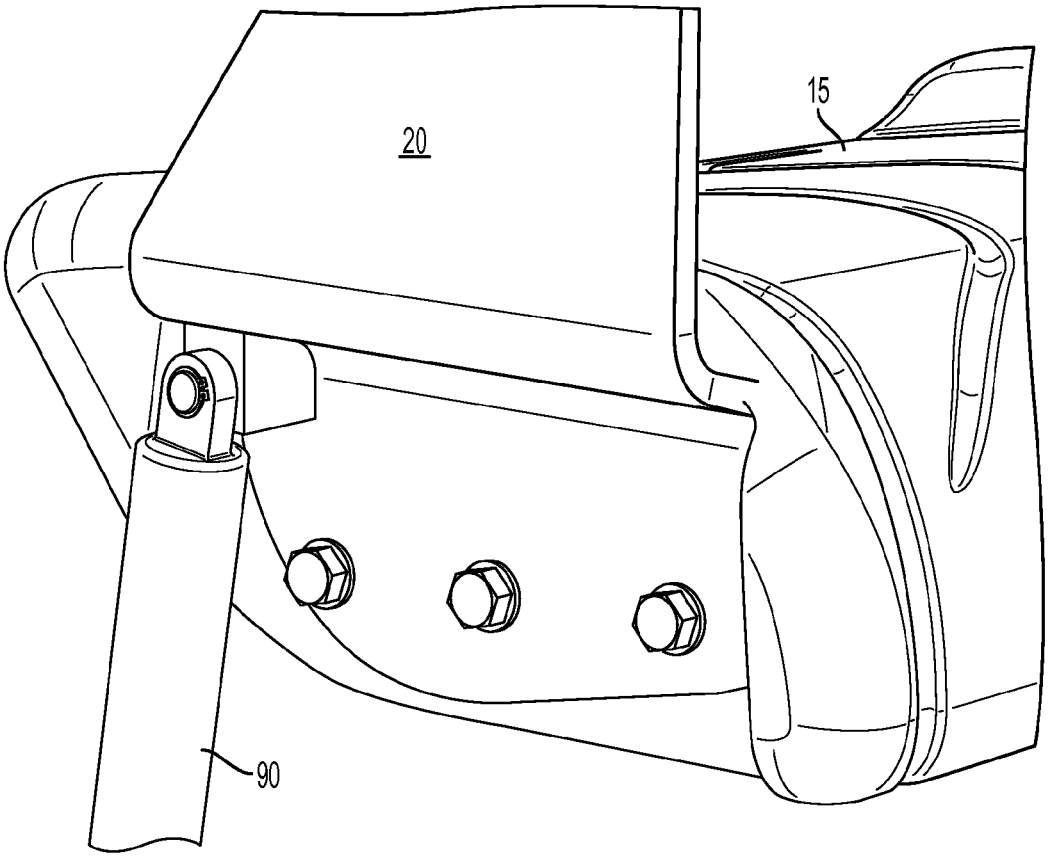
FIG. 2B illustrates a right-side view of a connection of a gas spring to a seat base.
Figure 4:
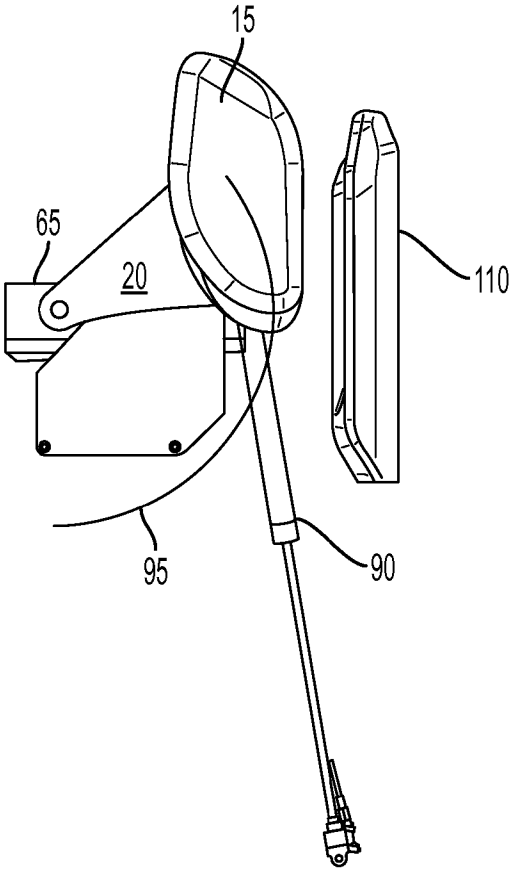
FIG. 4 illustrates a left side partial assembly view of the moveable seat of FIG. 1 at a standing position.

An adjustment mechanism, such as gas spring 90, is optionally included and may facilitate moving the seat base 15 to one or more positions, holding the seat base 15 at one or more positions, or both. An adjustment mechanism may comprise an electrically, hydraulically, or pneumatically actuated linear actuator which may apply motive power to move a seat base from a seated position to a standing position, from a standing position to a seated position, or both; an electrically, hydraulically, or pneumatically actuated rotary actuator which may utilize a different pivot arrangement from what is illustrated in the Figures and may apply motive power to move a seat base from a seated position to a standing position, from a standing position to a seated position, or both; or other suitable devices may be used. Optionally, gas spring 90 is lockable, that is, the force of the spring may be overcome by a locking mechanism, to hold the gas spring 90 at any desired position within its range of motion. As illustrated, the spring force of gas spring 90 urges the gas spring 90 to extend and thus move the seat base 15 from the seated position (FIG. 1) to the standing position (FIG. 3) when the locking mechanism is released, for example, by pushing a button located on a vehicle and operatively connected to the gas spring 90. Preferably, gas spring 90 is secured to the seat base 15 such that extension of the gas spring 90 moves the back end 30 of the seat base 15 away from a floor (FIG. 2B). Optionally, gas spring 90 may be secured to the cantilever arm 20 to move the seat base 15 away from a floor.

In some embodiments, an adjustment mechanism, such as gas spring 90, enables a user to maintain contact with a seat base, such as seat base 15, during an adjustment operation and throughout the range of adjustability. For example, a user sitting on a seat base 15 associated with a gas spring 90, or other suitable adjustment mechanism, may disengage, or unlock, the adjustment mechanism to move the seat base from a seated position toward a standing position and at the same time may lift the user's weight, at least partially, from the seat base 15 via the user's legs. The force provided by the adjustment mechanism may move the seat base against one or more of the user's legs, buttocks, and back to maintain contact with the user as the user moves from a seated position toward a standing position. When a desired adjustment has been made to the seat base 15, the user may re-engage, or lock, the adjustment mechanism and transfer the user's weight back to the seat base 15 to support the user at the new position. A similar, but opposite, procedure may be performed when transitioning from a standing position toward a seated position, with the user applying the user's weight to overcome any force supplied by an adjustment mechanism. Preferably, a top surface, such as top surface 32 of seat base 15, is presented to the user throughout the range of adjustment and at all seat positions.

Optionally, when included, gas spring 90 may absorb a portion of a shock transmitted to the supporting structure such that an amount of shock transmitted to the seat base 15 is less than the amount of shock transmitted to the support structure. For example, the support structure may include portions of an operator's compartment of a rider pallet truck. When the rider pallet truck encounters a bump a shock is transmitted to the rider pallet truck, including the operator's compartment. Gas spring 90 may be attached between a wall of the operator's compartment and the seat base 15 such that the gas spring 90 absorbs a portion of the transmitted shock due to the spring action of the gas spring 90. Thus, a lesser amount of shock is transmitted to the seat base 15.

In the embodiment illustrated in FIGS. 1-8, the configuration and length of the cantilever arm 20 provides a travel path 95 (FIG. 4) for the seat base 15. Such a travel path 95 provides a larger amount of displacement for the seat base 15 compared to a typical seat that pivots about a pivot point that is either connected to the seat or has a pivotal axis that passes through the seat. In other words, the travel path facilitates displacement of the entire seat base from one position to another. In contrast, commonly available rotating seats provide rotational displacement of portions of a seat while another portion of the seat remains at substantially the same location. Other commonly available rotating seats employ relatively complex mechanisms to create compound movement of a seat that combines linear and arcuate travel, and use relative rotation between such a seat and the supports connected thereto. One advantage provided by travel path 95 may be the ability to position the seat base 15 at a seated position and at a standing position where the seat base 15 is located proximate a user's middle or upper back instead of a user's lower back to provide a more desirable user support for a standing position compared to a typical seat that pivots about a pivot point connected to or coinciding with the seat. Another advantage provided by travel path 95 may be using a relatively simple mechanism to create arcuate movement along travel path 95. For some embodiments, the travel path may be linear, for example, when a seat base includes a connection device that follows or moves along a linear slot, track, or guide.

Optionally, a seat support, such as seat support 100 (FIG. 2), may be affixed to the support structure. In the illustrated embodiment, the support structure includes first wall 25 and a second wall 105 that is substantially perpendicular to the first wall 25. For example, the first wall 25 and the second wall 105 may comprise walls of an operator's compartment of a rider pallet truck or other suitable vehicle, or may comprise walls or a portion of an office cubicle, other suitable furniture, or of a freestanding support. The term "wall" thus means a support surface and is not limited to the traditional concept of a wall. For example, a support beam or arm may comprise a wall for certain embodiments. A wall does not need to be planar. The seat support 100 is attached to a second wall 105 and located such that a portion of the seat base 15 engages the seat support 100 when the seat base 15 is placed in the seated position. Engagement of the seat base 15 with the seat support 100 operates to transfer at least a portion of the weight of the seat base 15 and of any load it bears to the seat support 100, thus reducing the amount of weight that would otherwise be supported by the cantilever arm 20.

Optionally, a back rest, such as back rest 110, may be attached to the support structure. For example, back rest 110 is attached to the second wall 105 above the optional seat support 100 and operates to cushion a user's back when the user sits on the seat base 15 when located at the seated position. Preferably, the back rest 110 does not contact a user when the user leans against the moveable seat 10 when the seat base 15 is at the standing position. Optionally, the back rest 110 may be sized and positioned to contact a user, singly or in combination with the seat base 15, when the user leans against the moveable seat 10.

Optionally, the seat base 15 may be moveably connected to the cantilever arm 20. For example, the seat base 15 may slide with respect to the cantilever arm 20 and thus may be adjustable with respect to the height of the seat base 15 above a floor when the seat base 15 is at the standing position. Such adjustability may provide users the ability to adjust the height of the seat base 15 above a floor to a desired position, for comfort, optimal support, or other suitable reason. Such adjustability may also provide users the ability to adjust the location of the seat base 15 with respect to a back rest 110 to a desired position, for comfort, optimal support, or other suitable reason. In some embodiments, the seat base 15 may be detachably secured to the cantilever arm 20 to facilitate replacing or repairing the seat base 15 without requiring disassembly of the support structure or other portion of the moveable seat 10.

Figure 9:
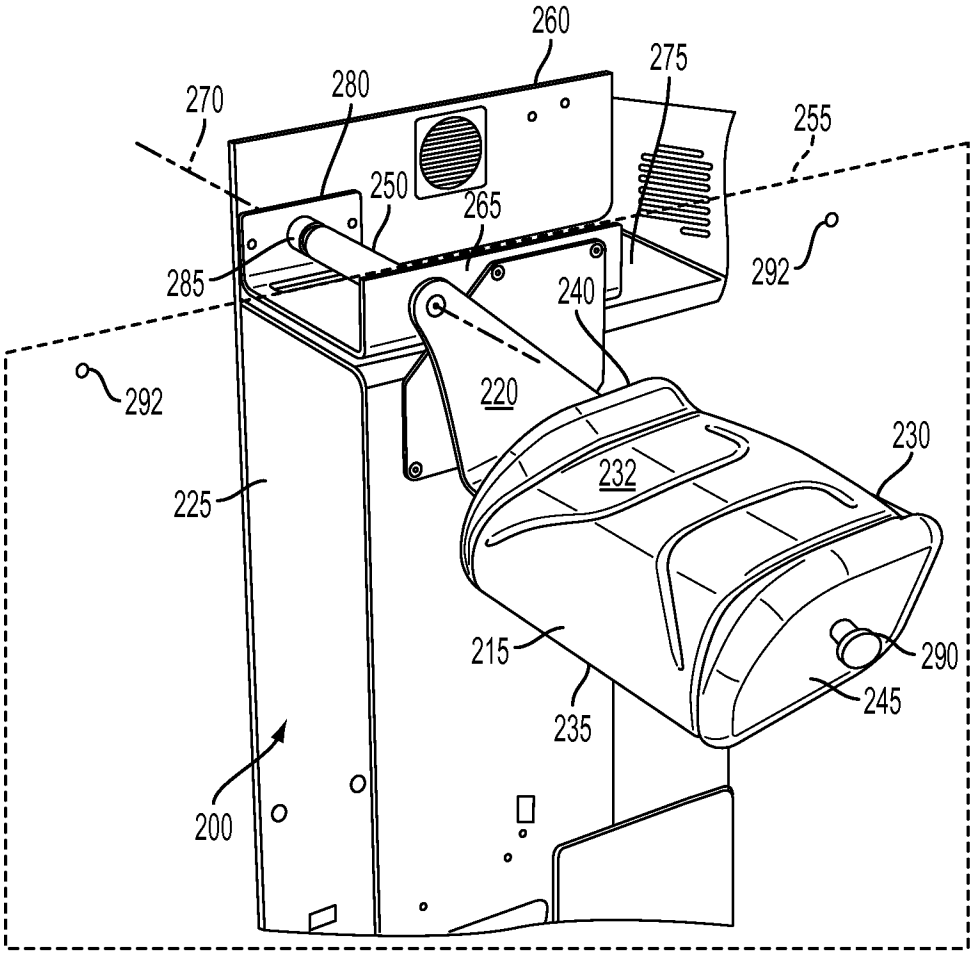
FIG. 9 illustrates a left front partially cut-away isometric view of another exemplary moveable seat at a seated position.
Figure 11:
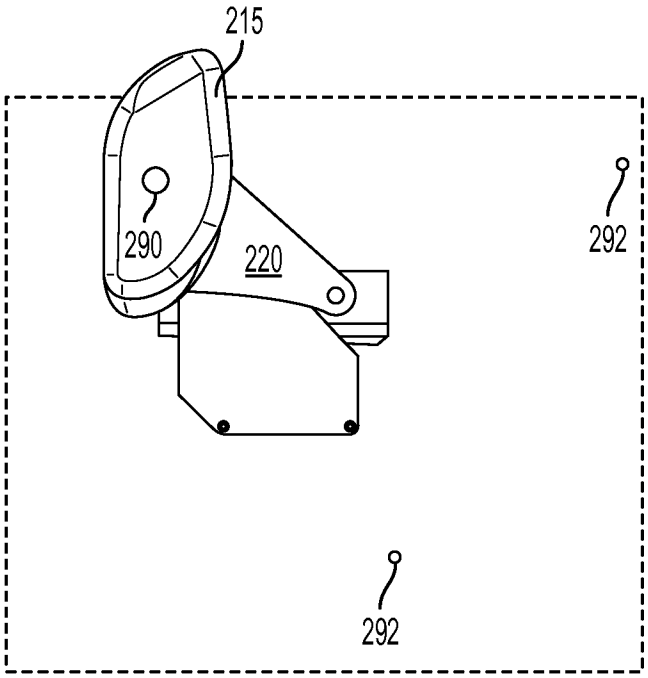
FIG. 11 illustrates a left side partially cut-away view of the moveable seat of FIG. 9 at a second standing position.
Figure 10:
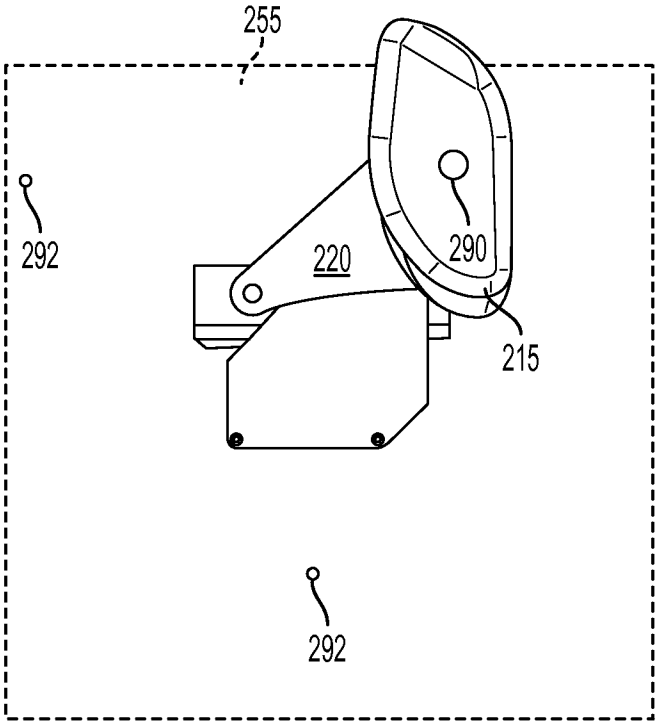
FIG. 10 illustrates a left side partial assembly view of the moveable seat of FIG. 9 at a first standing position.

Another embodiment, such as moveable seat 200 illustrated in FIGS. 9-11, may find use in applications where a user desires to sit or stand while facing one direction and also desires to sit or stand while facing a direction opposite to the first direction. For example, an operator of a vehicle equipped with two or more controls, or a moveable control may face two different directions depending on how the vehicle is operated. Seat base 215 is supported by a cantilever arm 220 which is in turn supported by a support structure, such as first wall 225. The seat base 215 includes a back end 230, a top surface 232, a front end 235, a first side 240 and a second side 245 where each of the sides 240 and 245 extend between the back end 230 and the front end 235. An intended sitting position for the seat base 215 is to have a user's legs extend over either the front end 235 or the back end 230 when seated.

Cantilever arm 220 is affixed to a first end of a pivot shaft 250 that extends through an inside wall portion 255 of the wall 225 and through the wall 225 to an outside wall portion 260. Wall 225 may include air between the inside and outside wall portions 255 and 260, or optionally may include a solid material between the inside and outside wall portions 255 and 260. Optionally, the pivot shaft 250 may simply extend through an aperture in the inside wall portion 255, but preferably a pivot bearing, such as bracket 265, reinforces the inside wall portion 255 and bears at least some of the weight of the seat base 215 and any load placed upon it. The pivot bearing supports the pivot shaft 250 such that pivot shaft 250 may rotate about its longitudinal axis 270. For example, the bracket 265 may optionally include a low-friction insert made of a polymer or other suitable material, a ball bearing race, or other suitable device for facilitating rotation of the pivot shaft 250. The pivot bearing also hinders the pivot shaft 250 from moving towards a floor, such as the floor of a rider pallet truck, by creating a physical obstacle against such movement. Optionally, the pivot bearing may be affixed to one or more support structures internal to the wall 225. For example, bracket 265 is secured to beam 275 within wall 225.

The second end of the pivot shaft 250 is rotatably supported by the outer wall portion 260. For example, the second end of the pivot shaft 250 optionally protrudes into or through an aperture (not illustrated) in the outer wall portion 260. Optionally, as illustrated, a pivot plate 280 may be affixed to the outer wall portion 260 and may include a boss or flange 285 to facilitate retaining the second end of the pivot shaft 250 such that the pivot shaft 250 rotates about its longitudinal axis 270 while hindering the pivot shaft 250 from moving towards a floor, such as the floor of a rider pallet truck, by creating a physical obstacle against such movement. Optionally, the pivot plate 280 may be mechanically linked to the bracket 265 as illustrated in FIG. 9, or the pivot plate 280 and the bracket 265 may be separate components. The boss or flange 285 optionally includes a device to facilitate rotation of the pivot shaft 250, such as a low-friction insert made of a polymer or other suitable material, a ball bearing race, or other suitable device.

An adjustment mechanism, such as pull rod 290 cooperating with one or more apertures 292 in inside wall portion 255, is optionally included and may facilitate moving the seat base 215 to one or more positions, holding the seat base 215 at one or more positions, or both. Pull rod 290 extends through the seat base 215 and engages a spring (internal to seat base 215 and not illustrated) that urges the pull rod 290 toward the wall 225. The end of pull rod 290 that is proximate the wall 225 is shaped and sized to engage apertures 292 to lock seat base 215 into position. When a user desires to change the position of seat base 215, the distal end of pull rod 290 is pulled away from the wall 225 thus disengaging pull rod 290 from an aperture 292. The seat base 215 is pivoted about pivot shaft 250 to a new position and the user releases pull rod 290 thus permitting the pull rod to engage an aperture 292 situated at the new position. Any number of apertures 292 may be provided to hold the seat base 215 at various positions.

The seat base 215 is mounted to the support structure such that the seat base 215 is moveable between at least three positions. For example, the seat base may be moved to a seated position as illustrated in FIG. 9, to a first standing position as illustrated in FIG. 10, and optionally, to positions intermediate the seated position and the first standing position, for example, by including more apertures 292, to a second standing position as illustrated in FIG. 11, and optionally, to positions intermediate the seated position and the second standing position.

As with the previous embodiment, the length of the cantilever arm 220 provides a travel path for the seat base 215 and may provide similar displacement and adjustability advantages as discussed with respect to FIGS. 1-8.

Optionally, the seat base 215 may be moveably connected to the cantilever arm 220. For example, the seat base 215 may slide with respect to the cantilever arm 220 and thus may be adjustable with respect to the height of the seat base 215 above a floor when the seat base 215 is at the standing position. Such adjustability may provide users the ability to adjust the height of the seat base 215 above a floor to a desired position, for comfort, optimal support, or other suitable reason. Such adjustability may also provide users the ability to adjust the location of the seat base 215, for example, horizontally toward or away from a set of vehicle controls to a desired position, for comfort, ability to reach the controls, optimal support, or other suitable reason. In some embodiments, the seat base 215 may be detachably secured to the cantilever arm 220 to facilitate replacing or repairing the seat base 215 without requiring disassembly of the support structure or other portion of the moveable seat 210.

In some embodiments, an adjustment mechanism such as gas spring 90 may be moveably connected to a seat base such as seat base 215. For example, gas spring 90 may slidingly attach to seat base 215 (instead of including pull rod 290) such that gas spring 90 may be positioned to urge either the back end 230 or the front end 235 away from a floor when extending depending on where in the sliding range the end of gas spring 90 is positioned.

Figure 12:
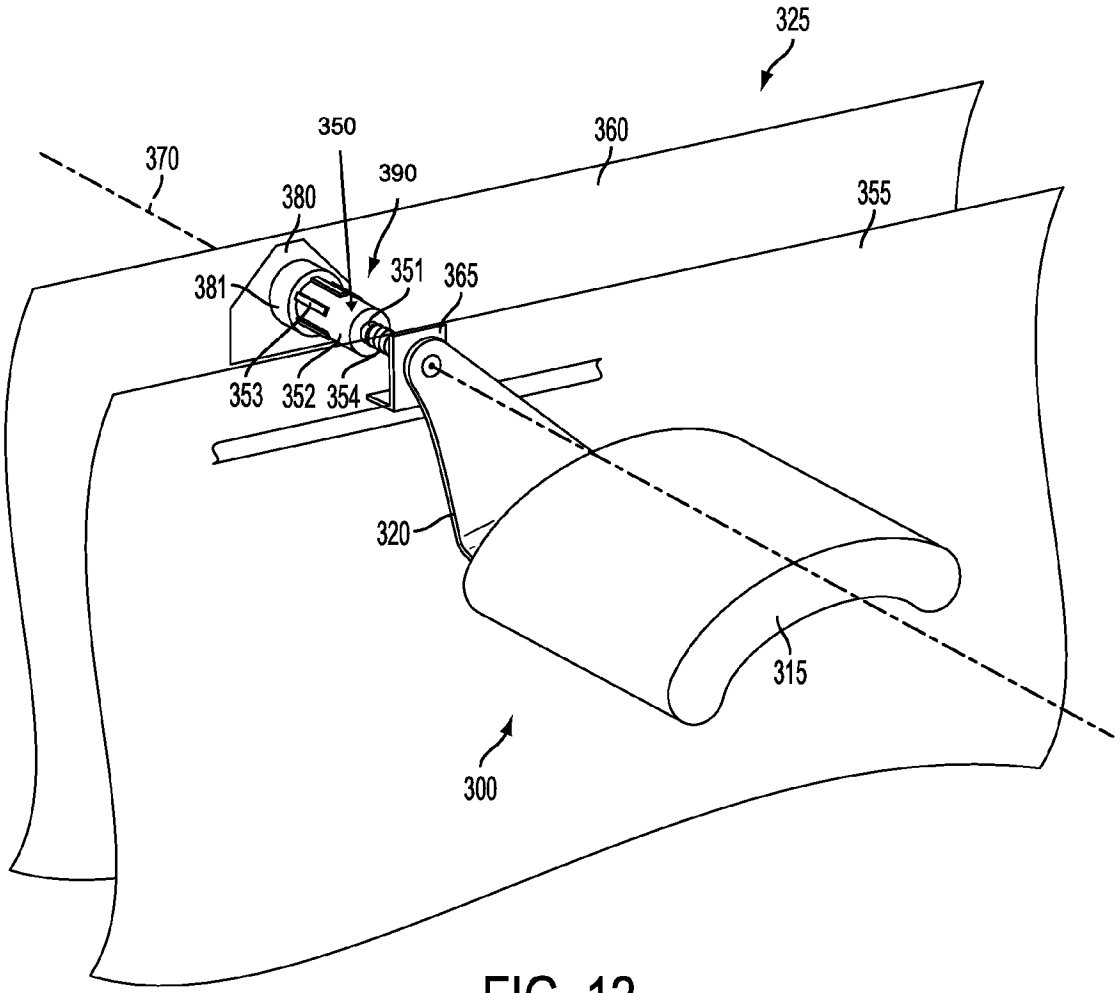
FIG. 12 illustrates a left front partially cut-away isometric view of another exemplary moveable seat at a seated position.

An alternate adjustment mechanism that may be used with the embodiment of FIGS. 1-8, or FIGS. 9-11, or other suitable embodiments is illustrated in FIG. 12.

The adjustment mechanism 390 includes a pivot shaft 350 that extends through an inside wall portion 355 of the wall 325 and through the wall 325 proximate to an outside wall portion 360. Preferably a pivot bearing, such as bracket 365, reinforces the inside wall portion 355 and bears at least some of the weight of the seat base 315 and any load placed upon it. The pivot bearing supports the pivot shaft 350 such that pivot shaft 350 may rotate about its longitudinal axis 370. For example, the bracket 365 may optionally include a low-friction insert made of a polymer or other suitable material, a ball bearing race, or other suitable device for facilitating rotation of the pivot shaft 350. The pivot bearing also hinders the pivot shaft 350 from moving towards a floor, such as the floor of a rider pallet truck, by creating a physical obstacle against such movement.

Pivot shaft 350 includes a small diameter portion 351 and a large diameter portion 352. A spline 353 is formed in the large diameter portion 352 distal from where the large diameter portion 352 joins the small diameter portion 351. A spring 354 is constrained between the large diameter portion 352 and the bracket 365 to urge the pivot shaft 350 towards the outside wall portion 360.

The splined end of the pivot shaft 350 is supported by a pivot plate 380 affixed to the outer wall portion 360. Pivot plate 380 includes an extended boss 381 that bears internal splines proximate to the outer wall portion 360 and a smooth bore portion distal from the outer wall 360. The extended boss 381 receives the splined end of the pivot shaft 350 such that the pivot shaft 350 may not rotate about its longitudinal axis 370 when the spring 354 urges the pivot shaft 350 into the extended boss 381. However, when a user pulls the seat base 315 and the cantilever arm 320 away from the wall 325 the spline 353 disengages from the splined portion of the extended boss 381 and moves into the smooth bore portion of the extended boss 381, thus permitting the pivot shaft 350 to rotate about its longitudinal axis 370. When a user releases the seat base 315, the spring 354 urges the pivot shaft 350 towards the outside wall portion 360, thus reengaging the spline 353 with the splined portion of the extended boss 381 and locking the seat base into a new position.

Figure 13A:
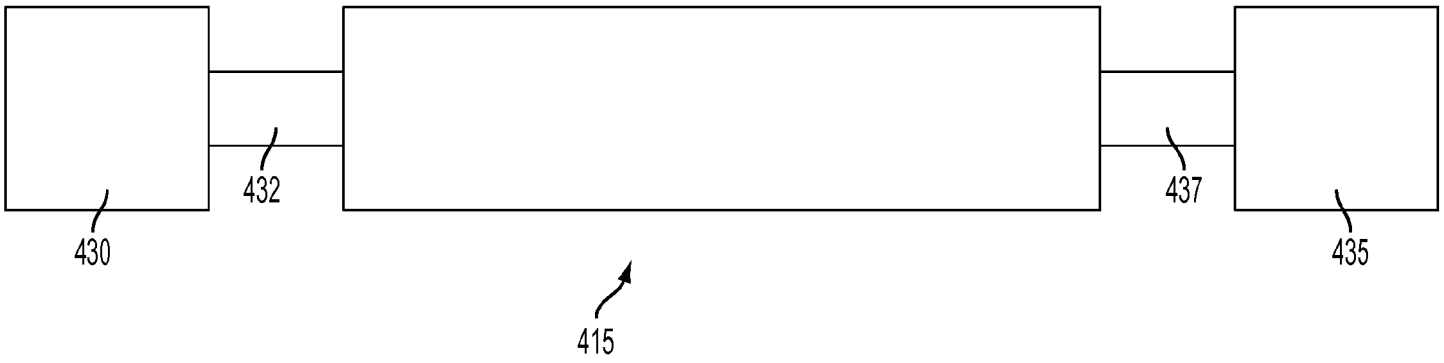
FIG. 13A illustrates a left side view of an exemplary seat base at a seated position with the back and front ends extended.
Figure 13B:
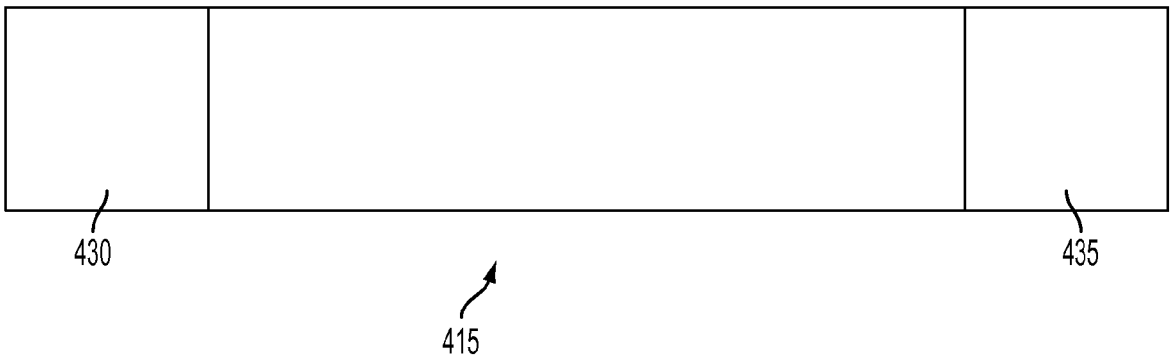
FIG. 13B illustrates a left side view of the seat base of FIG. 13A with the back and front ends collapsed.
Figure 14A:
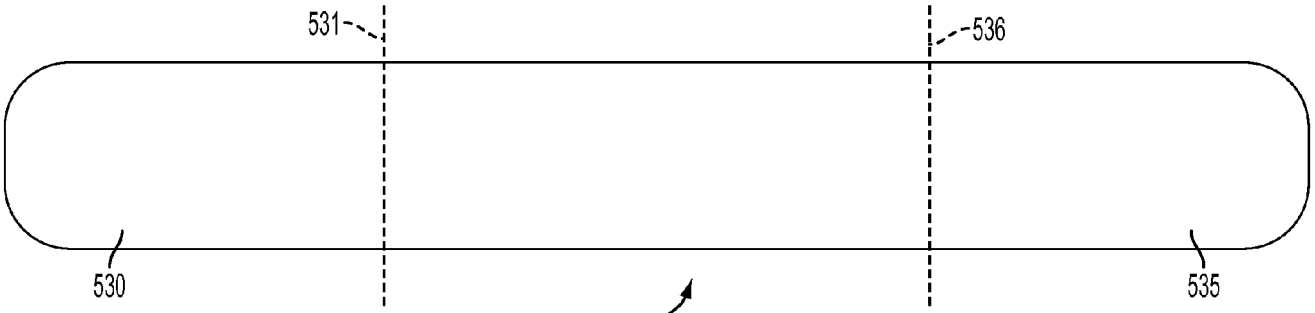
FIG. 14A illustrates a left side view of an exemplary seat base at a seated position with the back and front ends substantially aligned with the body of the seat base.
Figure 14B:
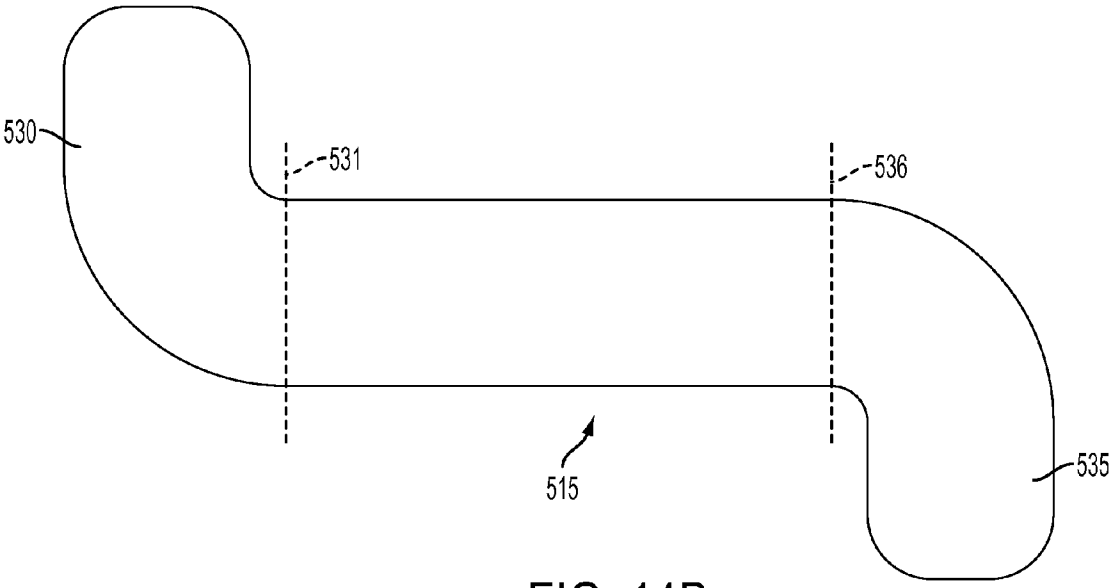
FIG. 14B illustrates a left side view of the seat base of FIG. 14A with the back and front ends bent out of alignment with the body of the seat base.

In other embodiments, the seat base, such as seat base 15, 215, 315, or other suitable seat base, may include a back end, front end, or both configured to translate away from and toward a center of the seat base. For example, seat base 415 (FIGS. 13A and 13B) includes a back end 430 and a front end 435 mounted on rails 432 and 437, respectively, for translation away from (FIG. 13A) and toward (FIG. 13B) a center of the seat base 430. In yet other embodiments, the seat base, such as seat base 15, 215, 315, or other suitable seat base, may include a back end, front end, or both configured to bend so as to be selectively positioned with or on either side of a central plane extending through the seat base and substantially parallel with a floor when the seat base is at a seated position. For example, seat base 515 (FIGS. 14A and 14B) includes a back end 530 and a front end 535 configured to bend about bend lines 531 and 536, respectively. An articulated mechanism (not illustrated) or other suitable mechanism may be provided internal to the seat base 515 for moving and holding one or both of back end 530 and front end 535 at a bent, or off-set position. As illustrated in FIG. 14B, the back end 530 may be moved to a position where it provides a support for a user's back, or at least a portion of a user's back, when at a seated position. The front end 535 may be moved to a position where it provides support for a user's legs, or at least a portion of a user's legs, when at a seated position. Optionally, the back end 530 and the front end 535 may also be configured to bend, or articulate, opposite to what is illustrated in FIG. 14B, i.e., the back end 530 may support a user's legs and the front end 535 may support a user's back when at the seated position.

In some embodiments, the support structure, such as support structure 625 (FIGS. 15A and 15B) may be freestanding thus providing a moveable seat, such as moveable seat 10, 200, 300, or other suitable moveable seat that may be used as an office chair, bar stool, or other suitable rest. For example, the moveable seat 600 illustrated in FIGS. 15A and 15B may be used by an office worker equipped with an adjustable work platform that permits the office worker to work in either a standing or seated position.

It will be apparent to those skilled in the art that various modifications and variations can be made to the systems and methods of the present disclosure. For example, the support structure may be part of a building, or part of office furniture, such as a cubicle wall. Various adjustment mechanisms may be used, with or without motive elements such as springs, electric actuators, or other suitable devices, and different devices may enable a cantilever arm, when included, to rotate or otherwise move. Other embodiments of the methods and systems will be apparent to those skilled in the art from consideration of the specification and practice of the methods and systems disclosed herein. It is intended that the specification and examples be considered as exemplary only, with a true scope of the invention being indicated by the claims of a non-provisional application and their equivalents.

The invention claimed is:

1. A positionable seat (10) comprising:

a seat base (15) having a back end (30), an opposing front end (35), a first side (40) extending between the back end (30) and the front end (35), a second side (45) extending between the back end (30) and the front end (35), and a top surface (32);

a cantilever connection device (20) having a first end affixed to the seat base (15) and a second end rotatably secured to a support structure (25) where an axis of rotation (70) about which the second end of the cantilever connection device (20) rotates is located above the seat base (15) such that the seat base (15) is between a floor and the axis of rotation (70) when the seat base (15) is at a seated position; and wherein the cantilever connection device (20) supports the seat base (15) and guides the seat base (15) along a travel path (95) between the seated position where the seat base (15) is located for a user to sit upon the seat base (15) with the user supported by the cantilever connection device (20) and the top surface (32) of the seat base (15) and (ii) a standing position where the seat base (15) is located for a user to lean against the top surface (32) of the seat base (15) with the user supported by the cantilever connection device (20) and the top surface (32) of the seat base (15).

2. A positionable seat (10) according to claim 1, further comprising:

an adjustment mechanism (90) operatively connected to the positionable seat (10), wherein the adjustment mechanism (90) releasably lockably secures the seat base (15) in at least the seated position and the standing position along the travel path (95).

3. A positionable seat (10) according to claim 2, wherein:

an end of the adjustment mechanism (90) is moveably secured to the seat base (15) for movement between a back position and a front position;

the adjustment mechanism (90) urges the back end (30) of the seat base (15) away from a floor when the adjustment mechanism (90) end is at the back position; and the adjustment mechanism (90) urges the front end (35) of the seat base (15) away from a floor when the adjustment mechanism (90) end is at the front position.

4. A positionable seat (10) according to claim 2, wherein:

the adjustment mechanism (390) comprises a shaft (350) having a longitudinal axis (370) and bearing a first set of splines (353), wherein the shaft (350) is connected to the cantilever connection device (320) second end; and the adjustment mechanism (390) further comprises a shaft receiver (381) affixed to the support structure (325) wherein the shaft receiver (381) includes a second set of splines shaped and sized to engage the first set of splines (353);

wherein the shaft (350) is mounted for longitudinal translation with respect to the shaft receiver (381) such that translational movement of the shaft (350) to a first position engages the first (353) and second sets of splines to prevent rotation of the shaft (350) about its longitudinal axis (270) and translational movement of the shaft (350) to a second position disengages the second set of splines from the first set of splines (353) to enable the shaft (350) to rotate about its longitudinal axis (370).

5. A positionable seat (10) according to claim 1, wherein the travel path (95) comprises an arc of a circle.

6. A positionable seat (10) according to claim 1, further comprising:

a seat support (100) attached to a portion of the support structure (25);

wherein the seat support (100) engages the back end (30) of the seat base (15) and bears at least a portion of a weight placed on the seat base (15) when the seat base (15) is at the seated position.

7. A positionable seat (10) according to claim 1, further comprising a back rest (110) affixed to a portion of the support structure (25).

8. A positionable seat (10) according to claim 1, wherein the support structure (25) comprises a first wall (25), and wherein the first wall (25) comprises an inside wall portion (55) and an outside wall portion (60) where the inside wall portion (55) is located between the seat base (15) and the outside wall portion (60).

9. A positionable seat (10) according to claim 8, further comprising:

a pivot shaft (50) having a first end connected to the second end of the cantilever connection device (20);

a pivot plate (80) affixed to the outside wall portion (60) of the first wall (25); and a pivot bearing (65) affixed to the inside wall portion (55) of the first wall (25);

wherein the pivot shaft (50) passes through the pivot bearing (65) which supports the pivot shaft (50) for rotation about its longitudinal axis (70) and hinders the pivot shaft (50) from moving towards or away from a floor; and wherein a second end of the pivot shaft (50) is rotationally supported by the pivot plate (80) which cooperates with the pivot bearing (65) and hinders the pivot shaft (50) from moving towards or away from a floor.

10. A positionable seat (10) according to claim 9, wherein the pivot plate (80) is further supported by an internal wall structure (75).

11. A positionable seat (10) according to claim 1, wherein:

the cantilever connection device (20) first end is slidably affixed to the first Side (40) of the seat base (15) such that the position of the seat base (15) may be adjusted with respect to the first end of the cantilever connection device (20) and thus adjust the height of the seat base (15) above a floor when the seat base (15) is at the standing position.

12. A positionable seat (10) according to claim 1, wherein:

the seat base (15, 415) back end (30, 430) includes a back end portion that is moveable away from and toward a center portion of the seat base (15, 415).

13. A positionable seat (10) according to claim 1, wherein:

the seat base (15, 515) back end (30, 530) includes a back end portion that is selectively adjustable to incline or decline with respect to a top surface of the seat base (15, 515); or the seat base (15, 515) front end (35, 535) includes a front end portion that is selectively adjustable to incline or decline with respect to a top surface of the seat base (15, 515).

14. A positionable seat (10) according to claim 1, wherein:

the top surface (32) of the seat base (15) is positioned to engage a user's back when the seat base (15) is at the standing position.

* * * * *